US012660968B2

(12) United States Patent
Perchaud

(10) Patent No.: US 12,660,968 B2
(45) Date of Patent: Jun. 23, 2026

(54) PORTABLE VACUUM CLEANER EQUIPPED WITH AN ACOUSTIC ABSORPTION WALL

(71) Applicant: SEB S.A., Ecully (FR)

(72) Inventor: Julie Perchaud, Ecully Cedex (FR)

(73) Assignee: SEB S.A., Ecully (FR)

( * ) Notice: Subject to any disclaimer, the term of this patent is extended or adjusted under 35 U.S.C. 154(b) by 323 days.

(21) Appl. No.: 18/684,524

(22) PCT Filed: Aug. 5, 2022

(86) PCT No.: PCT/FR2022/051562
§ 371 (c)(1),
(2) Date: Feb. 16, 2024

(87) PCT Pub. No.: WO2023/021254
PCT Pub. Date: Feb. 23, 2023

(65) Prior Publication Data

US 2025/0025004 A1 Jan. 23, 2025

(30) Foreign Application Priority Data

Aug. 17, 2021 (FR) ..... 21/08731

(51) Int. Cl.
*A47L 9/00* (2006.01)
*A47L 5/24* (2006.01)
*A47L 9/16* (2006.01)

(52) U.S. Cl.
CPC ..... *A47L 9/0081* (2013.01); *A47L 5/24* (2013.01); *A47L 9/1608* (2013.01); *A47L 9/1666* (2013.01); *A47L 9/1683* (2013.01)

(58) Field of Classification Search
CPC ..... A47L 9/0081; A47L 5/24; A47L 9/1608; A47L 9/1666; A47L 9/1683
See application file for complete search history.

(56) References Cited

U.S. PATENT DOCUMENTS 4,302,225 A 11/1981 Eckart et al.

FOREIGN PATENT DOCUMENTS

| | | | |
|---|---|---|---|
| FR | 2416678 | A1 | 9/1979 |
| FR | 3092979 | A1 | 8/2020 |
| FR | 3094622 | A1 | 10/2020 |
| JP | S5846918 | A | 3/1983 |

OTHER PUBLICATIONS

JPS5846918A(machine translation) (Year: 1983).*
International Search Report for Application No. PCT/FR2022/051562 mailed Dec. 9, 2022, pp. 1-3.

* cited by examiner

*Primary Examiner* — Andrew A Horton
(74) *Attorney, Agent, or Firm* — Lerner David LLP

(57) ABSTRACT

A portable vacuum cleaner includes a main body equipped with a suction duct, and a suction motor housed in the main body and configured to generate an air flow through the suction duct. The main body includes an air exhaust circuit through which the air flow generated by the suction motor is exhausted to the outside of the main body. The air exhaust circuit includes a filter having a generally cylindrical shape and delimiting an internal chamber fluidly connected to an air discharge orifice of the suction motor, and an acoustic absorption wall extending at least partly into the internal chamber of the filter, an internal surface of the filter and the acoustic absorption wall delimiting a first air conduit and a second air conduit in each of which is configured to circulate a part of the air flow.

14 Claims, 2 Drawing Sheets

PORTABLE VACUUM CLEANER EQUIPPED WITH AN ACOUSTIC ABSORPTION WALL

CROSS-REFERENCE TO RELATED APPLICATIONS

The present application is a national phase entry under 35 U.S.C. § 371 of International Application No. PCT/FR2022/051562, filed Aug. 5, 2022, published in French, which claims priority to French Application No. 21/08731 filed Aug. 17, 2021, all the disclosures of which are incorporated herein by reference in their entireties.

TECHNICAL FIELD

The present invention concerns the field of vacuum cleaners making it possible to vacuum up dust and waste present on a surface to be cleaned, which may for example be tiles, parquet, laminate, carpet or a rug.

STATE OF THE ART

A vacuum cleaner, and more particularly a portable vacuum cleaner, includes in a known manner a main body equipped with a suction duct, a waste separation and collection device mounted on the main body, and a suction motor housed in the main body, the suction motor having a motor axis and being configured to generate an air flow through the suction duct and the waste separation and collection device. The main body further comprises an air exhaust circuit through which the air flow generated by the suction motor is exhausted to the outside of the main body. Advantageously, the air exhaust circuit is equipped with a filter configured to filter the air flow flowing through the air exhaust circuit.

The noise generated during the operation of such a portable vacuum cleaner may, nonetheless, be significant, which may make the use of such a portable vacuum cleaner unpleasant.

SUMMARY OF THE INVENTION

The present invention aims to remedy all or part of these drawbacks.

The technical problem underlying the invention consists in particular of providing a portable vacuum cleaner which is simple and economical in structure, while significantly reducing the noise generated by the portable vacuum cleaner during its use.

For this purpose, the present invention concerns a portable vacuum cleaner comprising a main body equipped with a suction duct, a waste separation and collection device mounted on the main body, and a suction motor housed in the main body, the suction motor having a motor axis and being configured to generate an air flow through the suction duct and the waste separation and collection device, the main body further comprising an air exhaust circuit by which the air flow generated by the suction motor is exhausted to the outside of the main body, the air exhaust circuit being equipped with a filter configured to filter the air flow flowing through the exhaust air circuit.

The filter has a generally cylindrical shape and includes an internal surface delimiting an internal chamber which is fluidly connected to an air discharge orifice of the suction motor, and the air exhaust circuit includes an acoustic absorption wall which extends at least partly into the internal chamber of the filter, the internal surface of the filter and the acoustic absorption wall delimiting a first air conduit and a second air conduit in each of which is intended to circulate a part of the air flow.

By filter having a generally cylindrical shape, it is understood that the filter could possibly have a substantially frustoconical shape or a generally cylindrical shape with a C-shaped section or a section having the shape of a horseshoe. The internal chamber also adopts a generally cylindrical shape.

The specific configuration of the filter according to the present invention, associated with the presence of an acoustic absorption wall housed in an internal chamber of the filter, makes it possible to reduce the noise generated by the portable vacuum cleaner while generating low pressure losses. Indeed, the fact of separating the internal chamber of the filter into two makes it possible to significantly reduce the amplitudes of the acoustic waves passing through the internal chamber of the filter. The amplitudes of the acoustic waves are generally halved. This reduction in acoustic amplitudes significantly reduces the acoustic emissions of the air flow passing through the filter. Thus, such a configuration of the portable vacuum cleaner makes the use of the latter much more pleasant without significantly reducing the suction performance of the portable vacuum cleaner.

The portable vacuum cleaner may further have one or more of the following features, taken alone or in combination.

According to one embodiment of the invention, the acoustic absorption wall extends over at least part of the length of the filter, and for example over the entire length of the filter or over only a portion of the length of the filter.

According to one embodiment of the invention, the internal chamber has a circular cross section.

According to one embodiment of the invention, the first and second air conduits are separated from each other by the acoustic absorption wall.

According to one embodiment of the invention, the acoustic absorption wall is configured such that the first and second air conduits have substantially identical passage sections, and for example generally semi-cylindrical.

According to one embodiment of the invention, the filter has a longitudinal axis at the center of the filter.

Advantageously, the air exhaust circuit includes a single acoustic absorption wall which is arranged and centered on the longitudinal axis of the filter such that the acoustic absorption wall divides the internal chamber into two air conduits substantially identical. The use of a single acoustic absorption wall, advantageously centered on the longitudinal axis of the generally cylindrical filter, makes it possible to obtain two air conduits whose passage sections are substantially identical. Thus, the pressure losses induced by the air flows circulating in the two air conduits, the amplitudes and frequencies of the acoustic waves passing through the air conduits are then substantially identical, which makes it possible to further optimize the acoustic absorption in the configuration according to the invention where the acoustic absorption wall is arranged in the internal chamber of a generally cylindrical filter. On the contrary, an off-center acoustic absorption wall inside the internal chamber or several acoustic absorption walls arranged parallel in the internal chamber do not make it possible to obtain optimal results because the passage sections would be different in terms of section surfaces or section shapes.

According to one embodiment of the invention, the internal chamber includes a first open end and a second closed end which is opposite the first open end, the first open end of the internal chamber being oriented towards the suction motor. Such a configuration of the internal chamber, which is equipped with the acoustic absorption wall, further reduces the noise generated by the portable vacuum cleaner.

According to one embodiment of the invention, the acoustic absorption wall includes a first end portion and a second end portion which is opposite the first end portion, the first end portion of the acoustic absorption wall being located axially substantially at the first open end of the internal chamber or projecting out of the internal chamber from the first open end.

According to one embodiment of the invention, the acoustic absorption wall is elongated and extends in an extension direction. Advantageously, the direction of extension is substantially parallel to the longitudinal axis of the filter.

According to one embodiment of the invention, the acoustic absorption wall extends along the longitudinal axis of the filter.

According to one embodiment of the invention, the acoustic absorption wall has a generally planar shape and extends in an extension plane. Such a configuration of the acoustic absorption wall makes it possible to further limit the pressure losses induced by the acoustic absorption wall.

According to one embodiment of the invention, the acoustic absorption wall comprises the longitudinal axis of the filter. Advantageously, the acoustic absorption wall symmetrically separates the internal chamber such that the first and second air conduits are substantially identical.

According to one embodiment of the invention, the longitudinal axis of the filter is substantially coaxial with the motor axis of the suction motor.

According to one embodiment of the invention, the extension plane of the acoustic absorption wall is substantially parallel to the longitudinal axis of the filter. Such an arrangement of the acoustic absorption wall makes it possible to further limit the pressure losses induced by the acoustic absorption wall. Advantageously, the extension plane of the acoustic absorption wall is substantially parallel to the motor axis of the suction motor.

According to one embodiment of the invention, the first and second air conduits extend substantially parallel to the longitudinal axis of the filter. Advantageously, the first and second air conduits extend substantially parallel to the motor axis of the suction motor.

In an embodiment different from the aforementioned mode, the longitudinal axis of the filter is parallel and distinct from the motor axis of the suction motor.

In an embodiment different from the aforementioned mode, the longitudinal axis of the filter is inclined relative to the motor axis of the suction motor.

According to one embodiment of the invention, the motor axis of the suction motor is intersecting with the acoustic absorption wall. Such an arrangement of the acoustic absorption wall further reduces the noise generated by the portable vacuum cleaner.

According to one embodiment of the invention, the acoustic absorption wall includes a structural support element and an acoustic absorption member which is made of porous material and which is fixed to the structural support element. The acoustic absorption member can for example be fixed to the structural support element by gluing or by any other fixing means. Such a configuration of the acoustic absorption wall makes it easier to fix it and hold it in position in the internal chamber. Furthermore, the structural element limits the deformations of the acoustic absorption wall and prevents vibration of the acoustic absorption wall when the air flow circulates in the internal chamber.

According to one embodiment of the invention, the acoustic absorption member is made of porous materials with open cavities.

According to one embodiment of the invention, the structural support element is a structural support core.

According to one embodiment of the invention, the structural support element is perforated. Such a configuration of the structural support element makes it possible to limit the pressure losses generated by the acoustic absorption wall.

According to one embodiment of the invention, the acoustic absorption member is fixed to the structural support element in such a way that the air flow must flow through the acoustic absorption member before being able to meet the structural support element. In other words, the acoustic absorption member is attached to the structural support element such that the air flow cannot directly encounter the structural support element.

According to one embodiment of the invention, the acoustic absorption member includes a first acoustic absorption portion and a second acoustic absorption portion which each have a generally planar shape and which extend substantially parallel to each other, and a third acoustic absorption portion which connects the first and second acoustic absorption portions together, the structural support element being disposed between the first and second acoustic absorption portions. Advantageously, the third acoustic absorption portion is oriented towards the suction motor.

According to one embodiment of the invention, the acoustic absorption member is folded on itself so as to form the first and second acoustic absorption portions.

According to one embodiment of the invention, the acoustic absorption member is an acoustic foam.

According to one embodiment of the invention, the structural support element is rigid.

According to one embodiment of the invention, the structural support element is a support frame.

According to another embodiment of the invention, the structural support element is a support plate provided with a plurality of through-passage orifices distributed over the support plate.

According to one embodiment of the invention, the air exhaust circuit comprises at least one air exhaust opening provided on the main body and through which the air flow generated by the suction motor is exhausted outside the domestic vacuum cleaner, the at least one air exhaust opening being oriented in a direction of orientation which extends substantially perpendicular to the acoustic absorption wall. This configuration makes it possible to optimize the air conduit between the filter inlet and the air exhaust opening provided on the main body. More specifically, this configuration makes it possible to limit the pressure losses between the filter inlet and the air exhaust opening and to further improve the acoustic attenuation performance of the filter. Advantageously, at least two air exhaust openings are provided on the main body. The two air exhaust openings are arranged such that an air exhaust opening is formed on the main body on each side of the acoustic absorption wall.

According to one embodiment of the invention, the at least one air exhaust opening opens into an upper external surface of the main body.

According to one embodiment of the invention, the suction duct is arranged in a front part of the main body.

According to one embodiment of the invention, the filter is located at the rear of the suction motor.

According to one embodiment of the invention, the air exhaust circuit further comprises an additional acoustic absorption element which is made of porous material and which is located upstream of the filter, the additional acoustic absorption element comprising a passage opening which is fluidly connected to the air discharge orifice of the suction motor and which is located opposite the first open end of the internal chamber of the filter.

According to one embodiment of the invention, the acoustic absorption wall extends partly into the passage opening.

According to another embodiment of the invention, the first end portion of the acoustic absorption wall could be set back from the passage opening, and therefore not extend through the passage opening.

According to one embodiment of the invention, the additional acoustic absorption element is made of porous materials with open cavities.

According to one embodiment of the invention, the additional acoustic absorption element is an acoustic foam.

According to one embodiment of the invention, the additional acoustic absorption element is located between the suction motor and the filter.

According to one embodiment of the invention, the additional acoustic absorption element has an annular shape.

According to one embodiment of the invention, the filter includes a first axial end face and a second axial end face which is opposite the first axial end face, the additional acoustic absorption element covering at least in part the first axial end face of the filter.

According to one embodiment of the invention, the additional acoustic absorption element comprises a first axial surface which is annular and which is oriented towards the suction motor, and a second axial surface which is annular and which is oriented towards the filter. Advantageously, the second axial surface of the additional acoustic absorption element is in contact with the first axial end face of the filter.

According to one embodiment of the invention, the filter includes a filtration part which is produced by a pleated filter media and having a generally tubular shape. In a variant, the filtration part could be produced by a tubular shaped foam. Such a configuration of the filter further improves the acoustic attenuation performance of the filter, and therefore further reduces the noise generated by the portable vacuum cleaner.

According to one embodiment of the invention, the main body delimits at least in part a reception chamber in which the filter and the acoustic absorption wall are removably received.

According to one embodiment of the invention, the portable vacuum cleaner includes a removable cover which is removably attached to the main body, the removable cover being configured to prevent access to the filter and the acoustic absorption wall when the removable cover is attached to the main body and to allow access to the filter and the acoustic absorption wall when the removable cover is removed. These arrangements allow easy access to the filter and the acoustic absorption wall, and to remove them from the main body for maintenance, and in particular for cleaning and/or replacement.

According to one embodiment of the invention, the removable cover is arranged on a rear face of the main body of the portable vacuum cleaner.

According to one embodiment of the invention, the portable vacuum cleaner includes at least one energy storage element, such as a rechargeable battery, configured to electrically power the portable vacuum cleaner, and in particular the suction motor.

According to one embodiment of the invention, the at least one energy storage element is housed in the main body, and for example in a gripping handle provided on the main body.

According to one embodiment of the invention, the waste separation and collection device is of the cyclonic type.

According to one embodiment of the invention, the waste separation and collection device extends along an extension axis which is transverse to the motor axis of the suction motor. Advantageously, the extension axis of the waste separation and collection device is substantially perpendicular to the motor axis.

According to one embodiment of the invention, the waste separation and collection device is removably mounted on the main body.

According to the embodiment shown in the figures, the portable vacuum cleaner includes a support structure arranged in the main body and configured to support the filter. The support structure includes for example a perforated support part of generally tubular shape and around which the filter is mounted, the perforated support part being configured to support the filter and extending between the acoustic absorption wall and the filter.

According to the embodiment shown in the figures, the support structure is also configured to support the additional acoustic absorption element.

BRIEF DESCRIPTION OF THE FIGURES

In any case, the invention will be clearly understood with the help of the description which follows with reference to the appended schematic drawings representing, by way of non-limiting examples, two embodiments of this vacuum cleaner.

DETAILED DESCRIPTION

Figure 1:
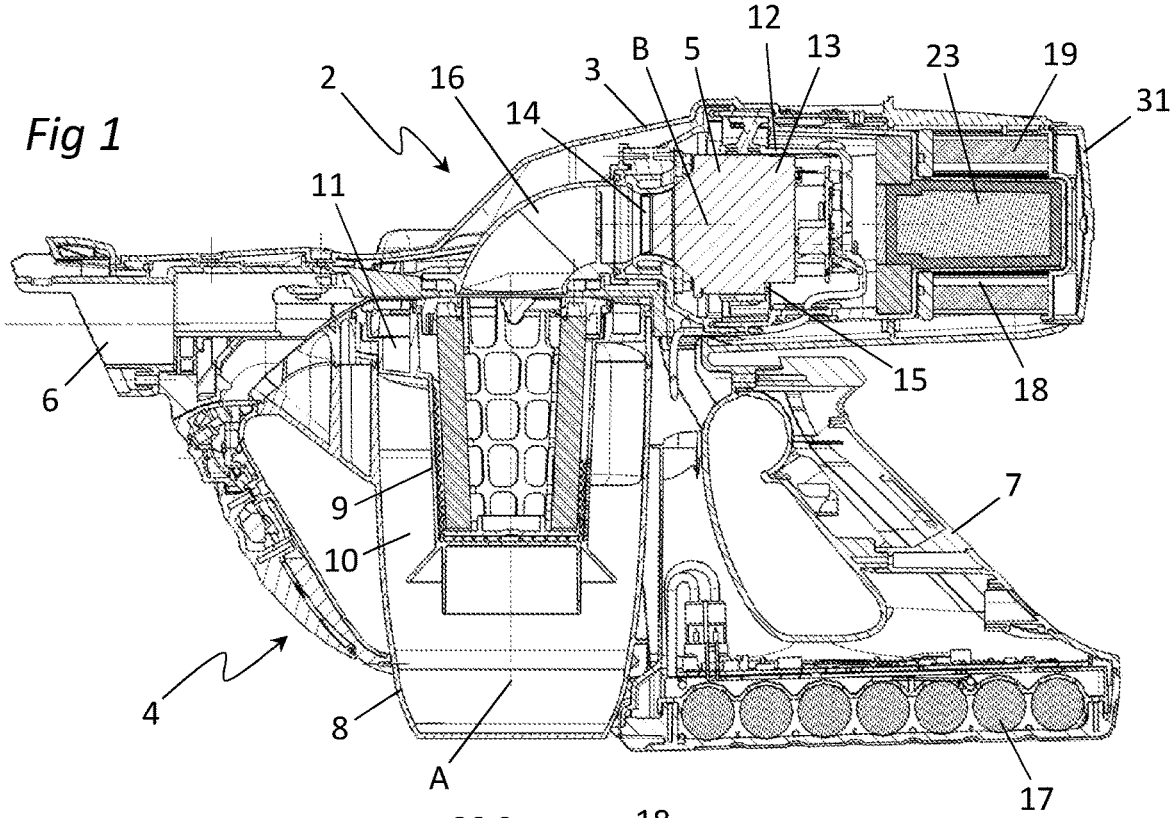
FIG. 1 is a longitudinal sectional view of a portable vacuum cleaner according to the invention.
Figure 2:
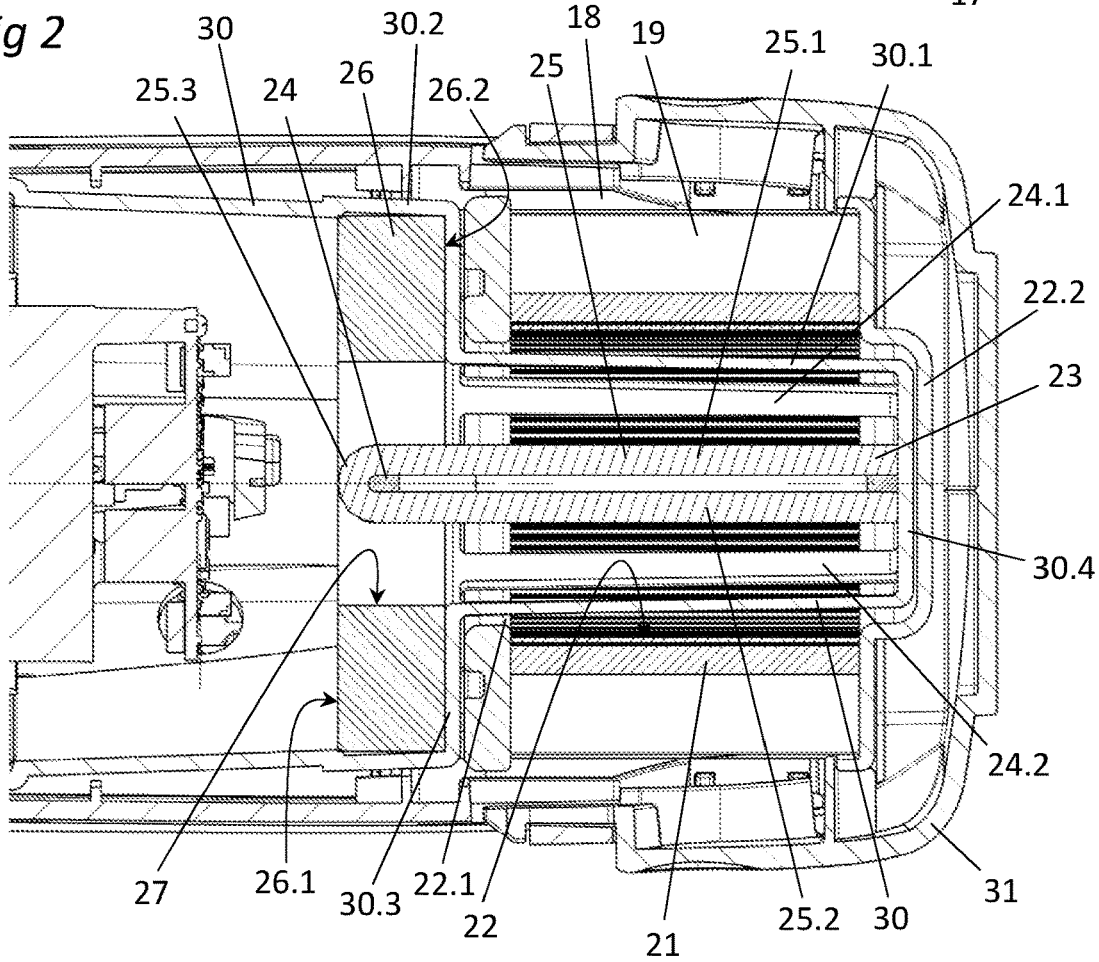
FIG. 2 is a partial longitudinal sectional view of the portable vacuum cleaner of FIG. 1 along a section plane perpendicular to that of FIG. 1.
Figure 3:
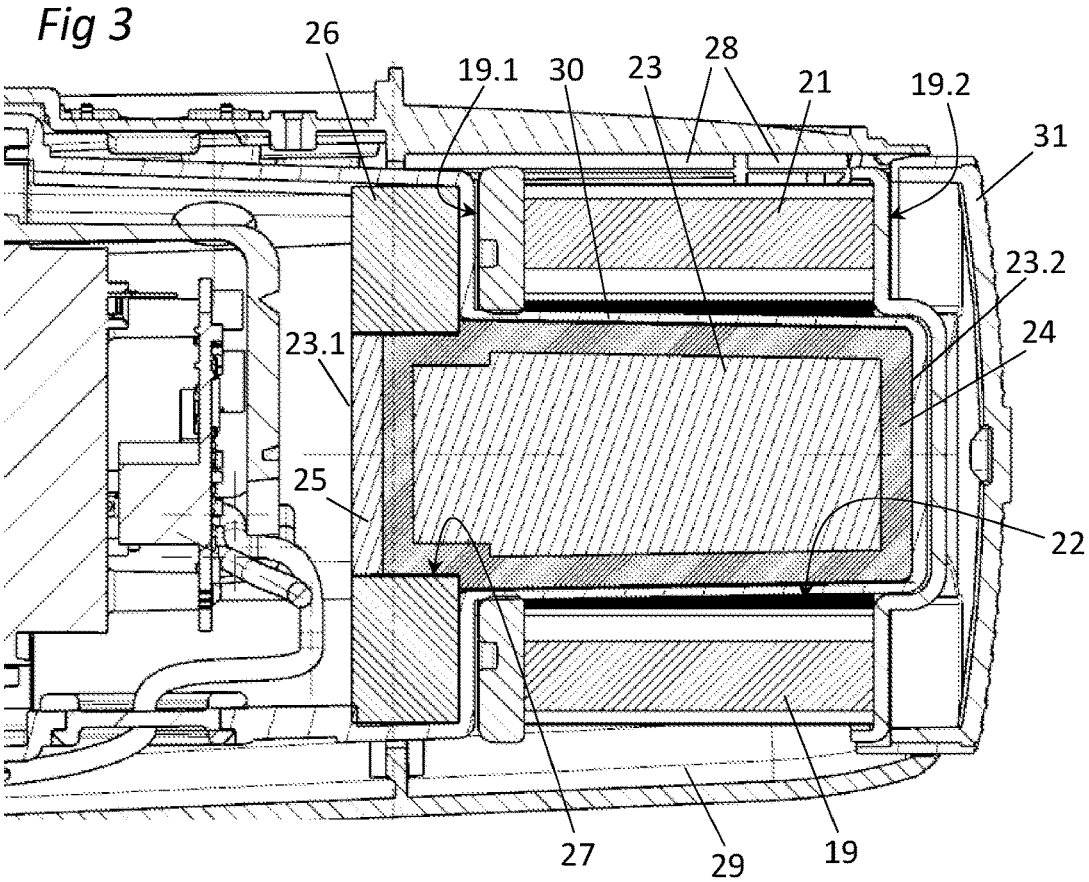
FIG. 3 is an enlarged scale view of a detail of FIG. 1.
Figure 4:
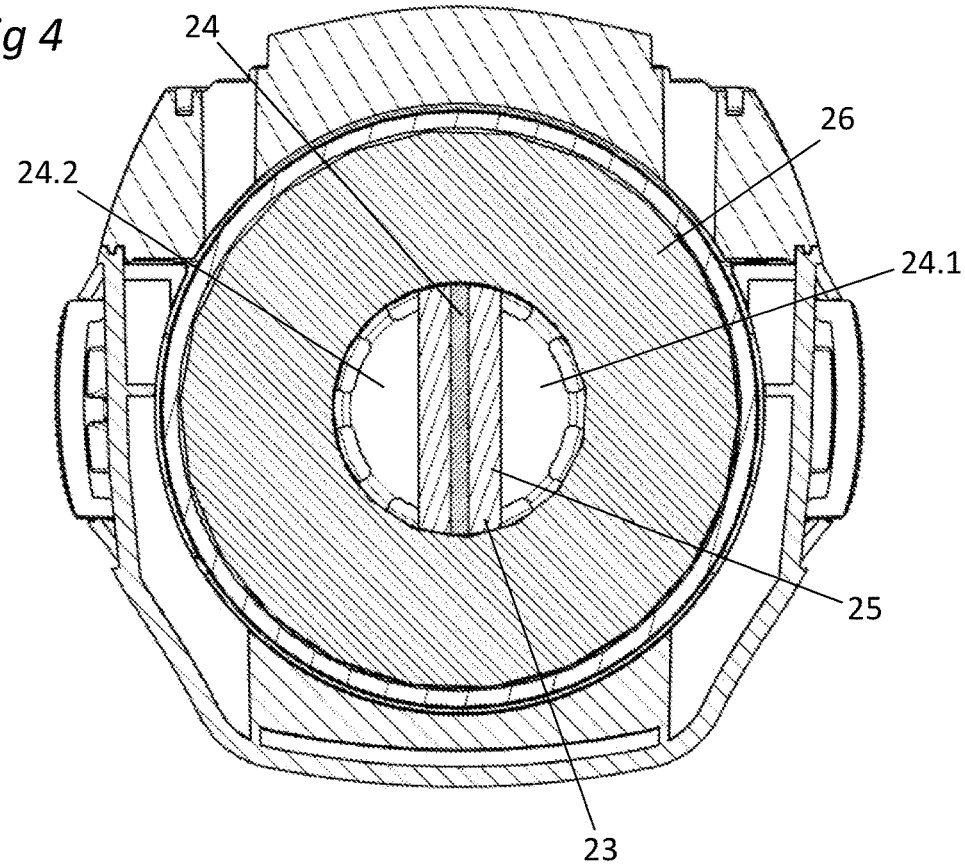
FIG. 4 is a cross-sectional view of the portable vacuum cleaner of FIG. 1.

In this document, the terms «upstream» and «downstream» are defined in relation to the direction of flowing of an air flow within the portable vacuum cleaner.

FIGS. 1 to 4 represent a portable vacuum cleaner 2 including a main body 3, a waste separation and collection device 4 removably mounted on the main body 3, and a suction motor 5 housed in the main body 3.

The main body 3 includes in particular a suction duct 6 through which outside air can be sucked in by the portable vacuum cleaner 2, and a gripping handle 7 allowing the portable vacuum cleaner 2 to be gripped by a user. Advantageously, the suction duct 6 is arranged in a front part of the main body 3, and the gripping handle 7 is arranged in a rear part of the main body 3.

According to the embodiment shown in the figures, the waste separation and collection device 4 includes a waste collection container 8 comprising a lateral wall of generally tubular shape. The waste separation and collection device 4 is advantageously of the cyclonic type, and further includes a tubular separation member 9, such as a tubular grid, which is arranged in the waste collection container 8 coaxially with a central axis of the waste collection container 8, and a cyclonic separation chamber 10 which is delimited externally by the lateral wall of the waste collection container 8, and internally by the tubular separation member 9. The waste separation and collection device 4 further includes an air intake opening 11 which is fluidly connected to the suction duct 6 and which opens into the cyclonic separation chamber 10.

The suction motor 5 is more particularly configured to generate an air flow through the suction duct 6 and the waste separation and collection device 4.

As shown on FIG. 1, the suction motor 5 includes a motor casing 12 and an electric fan 13 disposed in the motor casing 12. In known manner, the electric fan 13 includes a fan and an electric motor configured to rotate the fan.

The suction motor 5 further includes an air inlet orifice 14 and an air discharge orifice 15, and the portable vacuum cleaner 2 further comprises a connecting ducting 16 which fluidly connects the air inlet orifice 14 of the suction motor 5 to an air outlet opening of the waste separation and collection device 4.

According to the embodiment represented on the figures, the waste separation and collection device 4 extends along an extension axis A, and the suction motor 5 includes a motor axis B which extends transversely to the extension axis A, and advantageously perpendicular to the extension axis A.

The portable vacuum cleaner 2 further comprises an energy storage element 17, such as a rechargeable battery, configured to electrically power the electric fan 13. The energy storage element 17 is advantageously housed in the main body 3, and for example in the gripping handle 7.

The main body 3 further includes an air exhaust circuit 18 through which the air flow generated by the suction motor 5 is exhausted to the outside of the main body 3.

The air exhaust circuit 18 includes a filter 19 configured to filter the air flow flowing through the air exhaust circuit 18. The filter 19 has a generally cylindrical shape and has a longitudinal axis at the center of the filter which extends substantially coaxially with the motor axis B. Advantageously, the filter 19 is located at the rear of the suction motor 5.

The filter 19 includes a first axial end face 19.1 and a second axial end face 19.2 which is opposite the first axial end face 19.1, and further includes a filtration part 21 which is produced by a pleated filter media and having a generally tubular shape.

The filtration part 21 includes an internal surface which delimits an internal chamber 22 which is fluidly connected to the air discharge orifice 15 of the suction motor 5. Advantageously, the internal chamber 22 has a circular cross section, and includes a first open end 22.1 which is oriented towards the suction motor 5 and a second closed end 22.2 which is opposite the first open end 22.1 and which is located downstream of the first open end 22.1.

The air exhaust circuit 18 further includes an acoustic absorption wall 23 which extends at least partly into the internal chamber 22 of the filter 19, such that the internal surface of the filter 19 and the acoustic absorption wall 23 delimit a first air conduit 24.1 and a second air conduit 24.2 in each of which is intended to circulate a part of the air flow.

Advantageously, the acoustic absorption wall 23 is elongated and extends in an extension direction which is substantially parallel to the longitudinal axis of the filter 19. The acoustic absorption wall 23 may for example extend over the entire length of the filter 19, or only a portion of the length of the filter 19.

According to the embodiment represented on the figures, the first and second air conduits 24.1, 24.2 are separated from each other by the acoustic absorption wall 23, and the latter is configured such that the first and second air conduits 24.1, 24.2 have passage sections substantially identical, and for example generally semi-cylindrical.

According to the embodiment represented on the figures, the acoustic absorption wall 23 has a generally planar shape and extends in an extension plane which is substantially parallel to the longitudinal axis of the filter 19. Advantageously, the acoustic absorption wall 23 comprises the longitudinal axis of the filter 19, and the first and second air conduits 24.1, 24.2 extend substantially parallel to the longitudinal axis of the filter 19. Advantageously, the longitudinal axis of the filter 19 is located in the median plane of the acoustic absorption wall.

The acoustic absorption wall 23 includes a first end portion 23.1 which is located on the side of the suction motor 5 and a second end portion 23.2 which is opposite the first end portion 23.1. According to the embodiment represented on the figures, the first end portion 23.1 of the acoustic absorption wall 23 projects out of the internal chamber 22 from the first open end 22.1 of the internal chamber 22. However, according to one variant of the invention, the first end portion 23.1 of the acoustic absorption wall 23 could be located axially substantially at the first open end 22.1 of the internal chamber 22, or be located in removal of the first open end 22.1 of the internal chamber 22.

According to the embodiment represented on the figures, the acoustic absorption wall 23 includes a structural support element 24, which is advantageously rigid and perforated, and an acoustic absorption member 25 which is made of porous material and which is fastened to the structural support element 24 for example by gluing or by any other fastening means.

The structural support element 24 may for example be formed by a support frame, or by a support plate provided with a plurality of through-passage orifices distributed over the support plate. Advantageously, the acoustic absorption member 25 is an acoustic foam which may have a thickness comprised between 3 and 7 mm, and for example approximately 5 mm.

According to the embodiment represented on the figures, the acoustic absorption member 25 includes a first acoustic absorption portion 25.1 and a second acoustic absorption portion 25.2 which each have a generally planar shape and which extend substantially parallel relative to each other, and a third acoustic absorption portion 25.3 which connects the first and second acoustic absorption portions 25.1, 25.2 to each other. Such a configuration of the acoustic absorption member 25 is obtained by folding the acoustic absorption member 25 on itself.

The structural support element 24 is disposed between the first and second acoustic absorption portions 25.1, 25.2, and thus forms a structural support core. Advantageously, the third acoustic absorption portion 25.3 is oriented towards the suction motor 5, such that the air flow must flow through the acoustic absorption member 25 before being able to meet the structural support element 24. In other words, the acoustic absorption wall 23 is configured such that the air flow cannot directly meet the structural support element 24.

The air exhaust circuit 18 further includes an additional acoustic absorption element 26 which is made of porous material and which is located upstream of the filter 19. Advantageously, the additional acoustic absorption element 26 is located between the suction motor 5 and the filter 19.

The additional acoustic absorption element 26 may for example be an acoustic foam.

According to the embodiment represented on the figures, the additional acoustic absorption element 26 has an annular shape and includes a passage opening 27 which is fluidly connected to the air discharge orifice 15 of the suction motor 5 and which is located opposite the first open end 22.1 of the internal chamber 22 of the filter 19.

The additional acoustic absorption element 26 comprises a first axial surface 26.1 which is annular and which is oriented towards the suction motor 5, and a second axial surface 26.2 which is annular and which is oriented towards the filter 19.

According to the embodiment represented on the figures, the portable vacuum cleaner 2 includes a support structure 30 disposed in the main body 3 and configured to support the filter 19 and the additional acoustic absorption element 26. The support structure 30 includes more particularly:

- a perforated support part 30.1 of generally tubular shape and around which the filter 19 is mounted, the perforated support part 30.1 being configured to support the filter 19 and extending between the acoustic absorption wall 23 and the filter 19,
- an additional support part 30.2 of generally tubular shape and surrounding the additional acoustic absorption element 26, the additional support part 30.2 being configured to support the additional acoustic absorption element 26, and
- a bearing part 30.3 which connects the perforated support part 30.1 to the additional support part 30.2 and which is interposed between the filter 19 and the additional acoustic absorption element 26, the bearing part 30.3 comprising a first face against which the second axial surface 26.2 of the additional acoustic absorption element 26 bears, and a second face oriented towards the filter 19. The filter 19 may for example bear against the second surface of the bearing part 30.3.

The support structure 30 may also be provided with an end wall 30.4 located opposite the second closed end 22.2 of the internal chamber 22.

However, according to one variant of the invention, the second axial surface 26.2 of the additional acoustic absorption element 26 could be in contact with the first axial end face 19.1 of the filter 19, and the additional acoustic absorption element 26 could cover at least partly, and for example entirely, the first axial end face 19.1 of the filter 19.

According to the embodiment represented on the figures, the acoustic absorption wall 23 extends partly into the passage opening 27. However, according to one variant of the invention, the first end portion 23.1 of the acoustic absorption wall 23 could be located back from the passage opening 27, and therefore not extend through the passage opening 27.

The air exhaust circuit 18 further comprises air exhaust openings 28 provided on an external surface of the main body 3 and through which the air flow generated by the suction motor 5 is exhausted to the outside of the main body 3.

Advantageously, at least one, and for example each, of the air exhaust openings 28 is oriented in an orientation direction which extends substantially perpendicular to the acoustic absorption wall 23.

According to the embodiment represented on the figures, the main body 3 delimits at least in part a reception chamber 29 in which the filter 19 and the acoustic absorption wall 23 are removably received, and the portable vacuum cleaner 2 includes a removable cover 31 which is removably fastened to the main body 3 and which is configured to prevent access to the filter 19 and to the acoustic absorption wall 23 when the removable cover 31 is fastened to the main body 3 and to allow access to the filter 19 and to the acoustic absorption wall 23 when the removable cover 31 is removed. Advantageously, the removable cover 31 is disposed on a rear face of the main body 3 of the portable vacuum cleaner 2.

The operation of the vacuum cleaner 2 will now be described. When the electric fan 13 is electrically powered, it establishes a depression in particular in the waste separation and collection device 4 so that air and waste are sucked in by the suction duct 6. The air charged with waste then penetrates the waste collection container 8 via the air intake opening 11 which may for example emerge tangentially into the cyclonic separation chamber 10. The air is thus rotated and the waste is centrifuged outwards and this waste is collected by the waste collection container 8.

The air flow then flows successively through the air outlet orifice 11, the connecting ducting 16, and the air inlet orifice 14 and the air discharge orifice 15 of the suction motor 5. Then, the air flow flows through the passage opening 27 of the additional acoustic absorption element 26 and the first and second air conduits 24.1, 24.2, and then flows through the filtration part 21 before escaping out of the main body 3 through the air exhaust openings 28.

Of course, the present invention is in no way limited to the embodiment described and illustrated which has been given only by way of example. Modifications remain possible, particularly from the point of view of the constitution of the various elements or by substitution of technical equivalents, without departing from the scope of protection of the invention.

The invention claimed is:

1. A portable vacuum cleaner comprising: a main body including a suction duct, a waste separation and collection device mounted on the main body, and a suction motor housed in the main body, the suction motor having a motor axis and configured to generate an air flow through the suction duct and the waste separation and collection device, the main body further comprising an air exhaust circuit through which the air flow generated by the suction motor is exhausted to an outside of the main body, the air exhaust circuit including a filter configured to filter air flowing through the air exhaust circuit, wherein the filter is substantially cylindrical and includes an internal surface defining an internal chamber fluidly connected to an air discharge orifice of the suction motor, the air exhaust circuit including an acoustic absorption wall extending at least partly into the internal chamber of the filter, the internal surface of the filter and the acoustic absorption wall defining a first air conduit and a second air conduit, each configured to circulate a portion of air flow.

2. The portable vacuum cleaner according to claim 1, wherein the internal chamber includes a first open end and a second closed end opposite the first open end, the first open end oriented towards the suction motor.

3. The portable vacuum cleaner according to claim 2, wherein the acoustic absorption wall includes a first end portion and a second end portion opposite the first end portion, the first end portion located adjacent the first open end of the internal chamber or located such that the first end portion projects out of the internal chamber from the first open end.

4. The portable vacuum cleaner according to claim 2, wherein the air exhaust circuit further comprises an additional acoustic absorption element made of porous material and located upstream of the filter, the additional acoustic absorption element including a passage opening fluidly connected to the air discharge orifice of the suction motor and located opposite the first open end of the internal chamber of the filter.

5. The portable vacuum cleaner according to claim 4, wherein the acoustic absorption wall extends partially into the passage opening.

6. The portable vacuum cleaner according to claim 4, wherein the additional acoustic absorption element is an acoustic foam.

7. The portable vacuum cleaner according to claim 1, wherein the acoustic absorption wall is substantially planar and extends along an extension plane.

8. The portable vacuum cleaner-according to claim 7, wherein the filter has a longitudinal axis at a center of the filter, and wherein the extension plane of the acoustic absorption wall is substantially parallel to the longitudinal axis of the filter.

9. The portable vacuum cleaner-according to claim 8, wherein the longitudinal axis of the filter extends substantially coaxially with the motor axis of the suction motor.

10. The portable vacuum cleaner according to claim 1, wherein the motor axis of the suction motor intersects the acoustic absorption wall.

11. The portable vacuum cleaner according to claim 1, wherein the acoustic absorption wall includes a structural support element and an acoustic absorption member made of porous material and fastened to the structural support element.

12. The portable vacuum cleaner according to claim 11, wherein the structural support element is perforated.

13. The portable vacuum cleaner according to claim 11, wherein the acoustic absorption member includes a first acoustic absorption portion and a second acoustic absorption portion each being substantially planar and extending substantially parallel to each other, and a third acoustic absorption portion connecting the first and second acoustic absorption portions, the structural support element disposed between the first and second acoustic absorption portions.

14. The portable vacuum cleaner according to claim 1, wherein the air exhaust circuit-comprises at least one air exhaust opening provided on the main body and through which the air flow generated by the suction motor is exhausted outside the vacuum cleaner, the at least one air exhaust opening extending substantially perpendicular to the acoustic absorption wall.

* * * * *